United States Patent [19]

Hockett

[11] 4,370,836

[45] Feb. 1, 1983

[54] UNIVERSAL ABRASIVE CLEANING APPARATUS

[76] Inventor: Wayne B. Hockett, 1701 E. Sligh Ave., Tampa, Fla. 33610

[21] Appl. No.: 180,804

[22] Filed: Aug. 25, 1980

Related U.S. Application Data

[63] Continuation-in-part of Ser. No. 13,376, Feb. 21, 1979, abandoned, which is a continuation-in-part of Ser. No. 746,493, Dec. 1, 1976, Pat. No. 4,139,970, which is a continuation-in-part of Ser. No. 614,191, Sep. 7, 1975, Pat. No. 4,027,433.

[51] Int. Cl.[3] ..... B24C 3/00

[52] U.S. Cl. ..... 51/410; 118/323; 239/166; 51/429

[58] Field of Search ..... 51/410, 427, 429; 118/315, 323; 239/161, 166, 227, 252, 256, 450

[56] References Cited

U.S. PATENT DOCUMENTS

| | | | |
|---|---|---|---|
| 2,995,307 | 8/1961 | McMahon | 239/166 X |
| 3,566,543 | 3/1972 | Fogle | 51/429 X |
| 3,619,311 | 11/1971 | Rose et al. | 118/323 X |
| 3,747,277 | 7/1973 | Carpenter et al. | 51/429 X |

FOREIGN PATENT DOCUMENTS

| | | | |
|---|---|---|---|
| 52-36865 | 3/1977 | Japan | 239/166 |

*Primary Examiner*—James G. Smith
*Attorney, Agent, or Firm*—Frijouf, Rust & Pyle

[57] ABSTRACT

A universal abrasive cleaning apparatus comprising a plurality of arms which are rotatably connected in series with one another is provided. A plurality of nozzles are connected to the distal end of the series of arms by means of a nozzle support. Conduit apparatus interconnecting the nozzles to the source of abrasive and fluid are disposed within the interior of each arm thereby protecting the conduits from damage during manipulation of the arms. The proximal end of the series of arms is connected to a drum rotatably disposed within a housing. The drum is powered by a motor. A brake mechanism is connected to the housing for braking the drum during operation of the motor. An actuator is connected to each of the arms for rotating the arms about their respective axis of rotation. The actuator is controlled manually or by a microcomputer. The microcomputer receives rotational position information from sensors and directs the stream of abrasive and fluid emitted from the nozzles to trace a particular geometric pattern thereby cleaning an area of the work surface. The foregoing abstract is merely a resume of one general application, is not a complete discussion of all principles of operation or applications, and is not to be construed as a limitation on the scope of the claimed subject matter.

5 Claims, 10 Drawing Figures

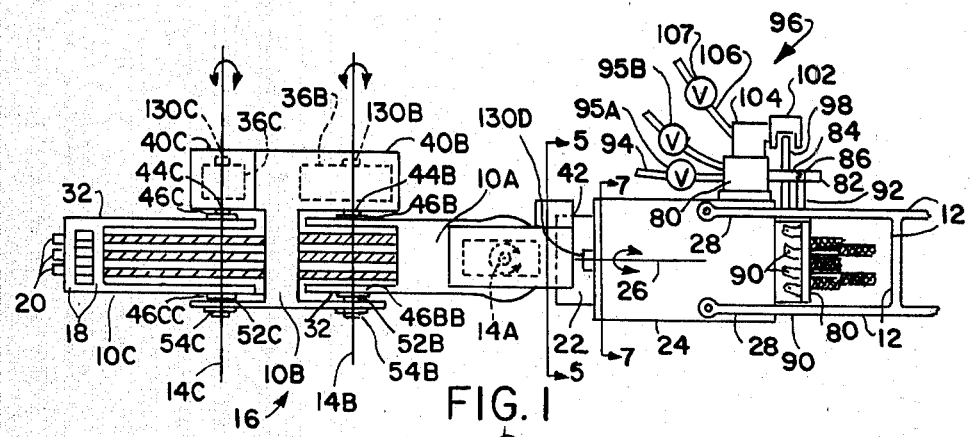
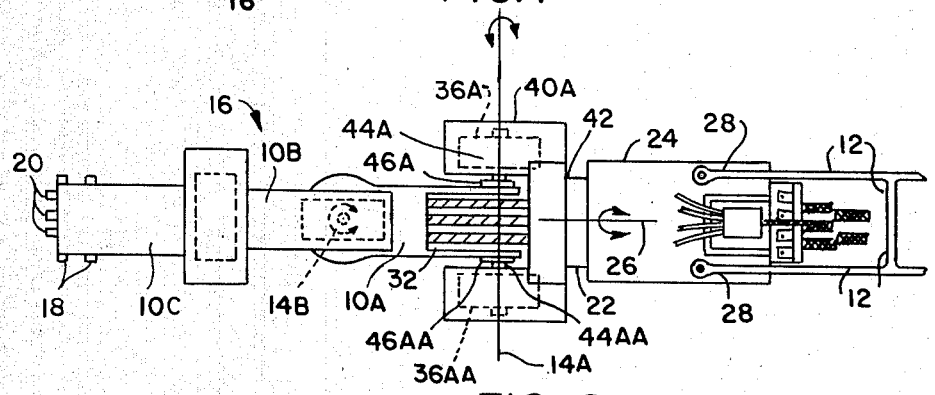
FIG. 2
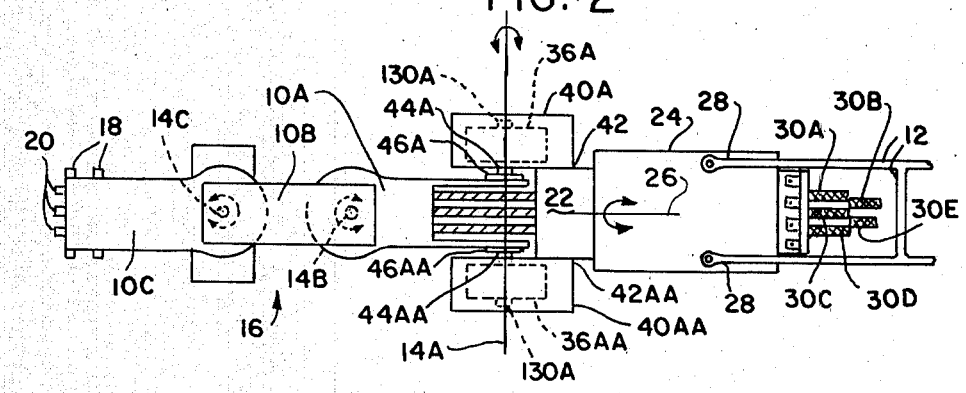
FIG. 3

UNIVERSAL ABRASIVE CLEANING APPARATUS

CROSS REFERENCE TO RELATED APPLICATIONS

This application is a continuation-in-part of my pending application, Ser. No. 013,376 filed Feb. 21, 1979, which application was a continuation-in-part of my prior application Ser. No. 746,493 filed Dec. 1, 1976, now U.S. Pat. No. 4,139,970. U.S. patent application 746,493 filed Dec. 1, 1976 was in turn a continuation-in-part of my first patent application, Ser. No. 614,191 filed Sept. 7, 1975 which issued as U.S. Pat. No. 4,027,433 and was subsequently reissued as RE 30,289.

All material presented in those applications is hereby incorporated into this application by reference.

BACKGROUND OF THE INVENTION

1. Field of the Invention

This invention relates to an abrasive cleaning apparatus having a plurality of arms rotatably pivoted together to permit movement of an abrasive nozzle relative to a work surface.

2. Description of the Prior Art

Sand blasting of surfaces prior to painting or simply cleaning, as in the case of stone or brick walls, is a common practice. Generally, sand blasting is accomplished by an operator positioned on a scaffold or other suitable support manually manipulating a single discharge nozzle. Obviously, the presence of the operator in the work zone makes sand blasting an extremely dirty and hazardous occupation. Moreover, the limited volume of the sand blasted against the work surface by a single nozzle is inefficient for many tasks.

As a result, the abrasive blast apparati used for large surface areas may employ multiple rather than a single blast nozzle. Multiple nozzles substantially increase the area of the blast pattern. Due to the increased weight and speed of the cleaning operation, the multiple nozzles and the operator are often mounted on a movable carriage or platform which is movable laterally and vertically along the work surface.

Unfortunately a number of difficulties have been experienced which hinder general acceptance and wide use of the multi-nozzle sand blasting apparatus. For example, multi-nozzle heads are of a type in which the sand and air are delivered and mixed in a common reservoir. The sand and the air are propelled simultaneously from the nozzles with all nozzles communicating directly with the common reservoir. In another configuration, each of the plural nozzles is provided with a separate supply line. In either of these arrangements, individual control of the angle of the nozzles is lacking in the prior art multiple nozzles apparati. Such manipulations of the blast angle of the nozzles is desirable in situations involving areas which present difficult cleaning problems. The blast from one nozzle must work on the difficult cleaning area for a prolonged period, during which time the other blast nozzles will blast at the surrounding areas.

Another difficulty with prior art multi-blast carriage arrangements is that the units are very cumbersome and complex so as to be suitable only for special cleaning operations. In addition, many prior art multiple nozzle machines lack adequate flexibility of movement and are not easily adaptable to various sand blasting tasks.

In my first patent, U.S. Pat. No. 4,027,433, I disclosed a novel arrangement for plural sand blasting nozzles. In this arrangement, the nozzles were disposed substantially parallel to one another and adapted for angular adjustment relative to the work surface. This patent overcame many disadvantages found in the prior art multiple nozzle devices.

In my second patent, U.S. Pat. No. 4,126,970, I disclosed a novel arrangement for utilizing the reaction force of a nozzle disposed in an angular adjustment relationship as in my first patent, U.S. Pat. No. 4,027,433. This invention was particularly suitable for cleaning the top or underside of a substantially horizontal surface.

In my third patent, U.S. Pat. No. 4,139,970, I disclosed another multiple nozzle apparatus utilizing the plural nozzle arrangement set forth in my first patent, U.S. Pat. No. 4,027,433. This invention is very desirable for cleaning a vertical surface since the operator is positioned on the apparatus with the plurality of nozzles mounted upon three perpendicular axes to obtain the proper blast angle relative to the work surface. The apparatus was adapted for elevation on a mobile lift platform making the apparatus suitable for blasting large vertical surface areas such as ship's hulls, oil tanks and other massive structures.

Finally, in my fourth invention, Ser. No. 963,689, filed Nov. 27, 1978, I disclosed an improvement over my second patent, U.S. Pat. No. 4,126,970, by providing an apparatus which requires minimal physical manipulation by an operator. An actuator rotates the abrasive cleaning nozzle about a second axis to control the reaction force nozzle enabling automatic alternate sweeping across the work surface about a first axis.

The above-mentioned patents have been proven to be most helpful in sand blasting massive structures. Experience has shown, however, that there exists great difficulty in cleaning structures having irregular shapes. Specifically, such irregular shapes may comprise doors, eaves, and other protuberences. To clean such irregular shapes, the prior art sand blasting devices teach the use of a single hand held nozzle which must be manually manipulated by the operator to direct the flow of the abrasive material about the surface of the irregular-shaped structure. As noted earlier, the presence of the operator in the work zone makes sandblasting an extremely dirty and hazardous occupation. Moreover, the limited volume of the sand blasted against the work surface by a single nozzle is time consuming and therefore economically inefficient for many tasks.

It is a primary objective of the present invention to provide a universal apparatus for cleaning a work surface with an abrasive under fluid pressure in a manner similar to those disclosed in my prior patents and further to clean irregular-shaped structures.

Another object of this invention is to provide an apparatus for cleaning a work surface with an abrasive under fluid pressure comprising a plurality of arms which are rotatably connected in series with one another and a plurality of nozzles disposed at the distal end of the arms to be positioned relative to the work surface by manipulation of the arms.

Another object of this invention is to provide an apparatus for cleaning a work surface with an abrasive under fluid pressure wherein the conduits connecting the nozzles to the source of abrasive and fluid are disposed within the interior of the arms thereby protecting the conduits from damage.

Another object of this invention is to provide an apparatus for cleaning a work surface with an abrasive under fluid pressure including actuator means for rotating each of the arms with respect to one another to direct the stream of the abrasive and fluid emitted from the nozzles at the work surface.

Another object of this invention is to provide an apparatus for cleaning a work surface with an abrasive under fluid pressure including means for physically controlling the actuator means thereby enabling the operator to selectively direct the stream of abrasive and fluid emitted from the nozzles at selected positions of the work surface.

Another object of this invention is to provide an apparatus for cleaning a work surface with an abrasive under fluid pressure including means for automatically controlling the actuation means to direct the stream of abrasive and fluid pressure emitted from the nozzle to sweep the work surface in a pre-programmable pattern.

Another object of this invention is to provide an apparatus for cleaning a work surface with an abrasive under fluid pressure wherein the proximal end of the series of arms is connected to a rotatable drum for rotation of the series of arms about the rotational axis of the drum.

Another object of this invention is to provide an apparatus for cleaning a work surface with an abrasive under fluid pressure including a brake means for braking the drum.

The foregoing has outlined some of the more pertinent objects of the invention. These objects should be construed as merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims taken in conjunction with the accompanying drawings.

SUMMARY OF THE INVENTION

This invention is defined by the appended claims with specific embodiments shown in the attached drawings and explained in the detailed discussion. For the purpose of summarizing the invention, the invention may be incorporated into an apparatus for cleaning a work surface with an abrasive under fluid pressure from a source abrasive and fluid pressure source. The apparatus comprises a plurality of arms which are rotatably connected in series with one another. Specifically, a first arm is rotatably connected relative to the base of the apparatus about a first axis of rotation. The second arm is rotatably connected to the first arm about a second axis of rotation. And finally, the third arm is rotatably connected to the second arm about a third axis of rotation. Although only three arms are described as constituting a series of arms, it should be understood that additional arms may be rotatably connected in series with the series of arms thus described, to increase the number of axes of rotations thereby extending the reach and flexibility of the series of arms.

An actuator means is provided for rotating the arms about their respective axis of rotation. The actuator means may comprise a pneumatic, electromechanical or hydraulic actuator. The actuators are controlled by an actuator control means which regulates the rate and direction of rotation of the arms about their respective axis of rotation. More specifically, in the case of pneumatic and hydraulic actuators, fluid or air pressure flowing into the one port of the actuator causes the axel of the actuator to rotate in one direction. Conversely, fluid flowing into another port causes the axel of the actuator to rotate in the other direction. A regulator valve means is provided for each actuator to create provide a uniform rate of rotation irrespective of gravitational or other forces acting on the arms.

Sensor means are provided for sensing the rotational position of the arms about their respective axis of rotation. In the preferred embodiment, sensor means comprises a potentiometer connected to the axel of each actuator. The electrical resistance of the potentiometer changes in proportion to the rotational position of the axel. Accordingly, the resistance of the potentiometer can be determined to sense the rotational position of the axel of the actuator and correspondingly, the rotational position of each arm about its respective rotational axis.

In a more specific embodiment of the invention, the proximal end of the series of arms is connected to a drum which rotates within a housing. Such a configuration enables the series of arms to rotate about the drum's axis of rotation. The drum is rotated within the housing by means of a continuous chain which interconnects a sprocket disposed on the drum and a corresponding sprocket disposed on a motor. The motor may be a pneumatic, electromechanical or hydraulic motor. Means for controlling the rotational movement of the motor is provided. In the case of a pneumatic or hydraulic motor, such controlling means may comprise a valve means which regulates the air pressure fluid flowing into the motor during operation. The valve may be electrically controlled by a solenoid or the like.

Finally, a plurality of nozzles are connected to the distal end of the series of arms by means of a nozzle support. A conduit means interconnects the nozzles to the source of abrasive and fluid. A particular feature of this invention is the fact that the conduits are disposed within the interior of each arm. The walls of the arms therefore protect the conduits from damage. The interior channels of the arms also provide a convenient path for interconnecting the actuator means and the sensors to the actuator control means and the controller means, respectively.

It should be noted that this invention may be utilized in a variety of applications such as dry sand blasting, water blasting, spray painting and vacuum recovery operations without departing from the spirit and scope of this invention.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view of the invention showing the plurality of arms which constitute the series of arms;

FIG. 2 is a top view of the invention shown in FIG. 1;

FIG. 3 is a bottom view of the invention shown in FIG. 1;

Similar reference characters refer to similar parts throughout the several views of the drawings.

DETAILED DESCRIPTION OF THE PREFERRED EMBODIMENT

Figure 4:
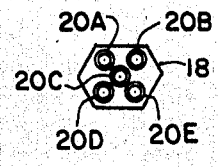
FIG. 4 is an end view of the invention shown in FIG. 1 showing the plurality of nozzles disposed within the nozzle support.

FIGS. 1, 2 and 3 are a side, top, and bottom view, respectively of the invention. A first arm 10A is connected relative to the base 12 about a first axis of rotation 14A. A second arm 10B is then connected to the first arm 10A about a second axis of rotation 14B. Finally, a third arm 10C is connected to the second arm 10B about a third axis of rotation 14C. The three arms 10A, 10B, and 10C connected together as thus described constitutes a series of arms 16. A nozzle support 18 is disposed at the distal end of the series of arms 16 for supporting a plurality of nozzles 20. In the preferred embodiment, the proximal end of the series of arms 16 is rotatably connected to a drum 22 which is in turn, rotatably disposed within a housing 24 about the drum's axis of rotation 26. The housing 24 is then connected to the base 12 by means of a weld 28 or the like.

As noted earlier, a nozzle support 18 is disposed at the distal end of the series of arms 16. The preferred embodiment, of the nozzle support 18 is octagonal-shaped and supports five nozzles 20A, 20B, 20C, 20D, and 20E in the particular spacial relationship as shown in FIG. 4. It should be noted that the nozzles 20 may alternatively be disposed in an array as set forth in my prior patents or any other spacial arrangement which may be suitable for cleaning a particular work surface. A plurality of conduits 30A, 30B, 30C, 30D, and 30E interconnect the nozzles 20A, 20B, 20C, 20D, and 20E, respectively, with the source of abrasive and fluid. An important feature of this invention is the fact that the conduits 30 are conveniently disposed within the interior 32 of the arms 10 and within the inside 34 of the drum 20. In this manner, the conduits 30 are protected from damage and abrasion during manipulation of the arms 10.

Referring again to FIGS. 1, 2, and 3, in the preferred embodiment, the first axis of rotation 14A is disposed perpendicular to the drum's axis of rotation 26. The second axis of rotation 14B is then disposed perpendicular to both the first axis of rotation 14A and the drum's axis of rotation 26. Finally, the third axis of rotation 14C is disposed parallel to the second axis of rotation 14B. It should be evident that manipulation of the arms 10 about their respective axis of rotation 14 enables the nozzles 20 to be positioned at any angle relative to the work surface. Such versatitlity enables the invention to be utilized in cleaning any work surface regardless of the particular shape or irregularity of the work surface.

Figure 5:
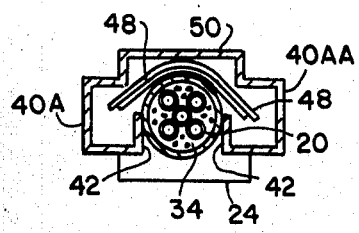
FIG. 5 is a cross-sectional view of FIG. 1 along lines 5—5.

Means are provided for imparting a rotational movement to the arms 10 about their respective axis of rotation 14. Such means may be any type of hydraulic, pneumatic, or electromechanical actuator commonly found in the art. In the preferred embodiment, however, pneumatic actuators 36 are utilized. Specifically, a first actuator 36A, second actuator 36B, and third actuator 36C are provided for imparting rotational movement to the arms 10A, 10B, and 10C about their respective axis of rotation 14A, 14B and 14C. More particularly, the first actuator 36A is secured within a first casing 40A which is in turn, connected to the drum 22 by means of a weld 42A or the like. The axel 44A of the first actuator 36A extends from the casing 40A and is connected to the proximal end of the first arm 10A by means of a plate 46A secured thereto. Upon operation of the first actuator 36A, the axel 44A thereof causes the first arm 10A to rotate about the first axis of rotation 14A. Another actuator 36AA is provided for assisting the first actuator 36A in rotating the first arm 10A about the first axis of rotation 14A. Actuator 36AA is enclosed within casing 40AA which is in turn, connected to the drum 22 by means of a weld 42AA. The axel 44AA of the actuator 36AA extends from the casing 40AA and is connected to the proximal end of the first arm 10A by means of a plate 46AA. Actuators 36A and 36AA are operated simultaneously with one another thereby assuring that the first arm 10A is easily rotated about the first axis of rotation 14A. The conduits 48 controlling the operation of the actuators 36A and 36AA (discussed later in more detail) lead through the inside 34 of the drum 22 and are connected to the actuators 36A and 36AA. As shown in FIG. 5, a cover 50 encloses the conduits 48 as the conduits 48 exit from the drum 22 and lead to the interior of the casings 40A and 40AA to be connected to the actuators 36A and 36AA.

A second pneumatic actuator 36B is provided for rotating the second arm 10B about the second axis of rotation 14B. The second actuator 36 is enclosed within a casing 40B which is in turn, connected to the second arm 10B. The axel 44B of the second actuator 36B extends from the casing 40B and is connected to the side of the second arm 10B by means of a plate 46B. Another axel 52B is rigidly secured to the other side of the second arm 10B by means of another plate 46BB. The axel 52B is then journalled within a journal support 54B disposed on the second arm 10B. Conduits controlling the operation of the second actuator 36B lead through the inside 34 of drum 22 and the interior 32 of the first and second arms 10A and 10B to the second actuator 36B.

Finally, a third actuator 36C is provided for rotating the third arm 10C about the third axis of rotation 14C. The third actuator 36C is disposed within a third casing 40C which is rigidly connected to the distal end of the second arm 10B. The axel 44C of the third actuator 36C extends from the casing 40C and is connected to the side of the third arm 10C by means of a plate 46C. Another axel 52C is rigidly connected to the other side of the third arm 10C by means of another plate 46CC. The axel 52C is then journalled within a journal support 54C distally disposed on the other side of the second arm 10B. The conduits controlling the operation of the third actuator 36C lead through the inside 34 of the drum 22 and the interior 32 of the arms 10A, 10B and 10C to the third actuator 36C.

Figure 6:
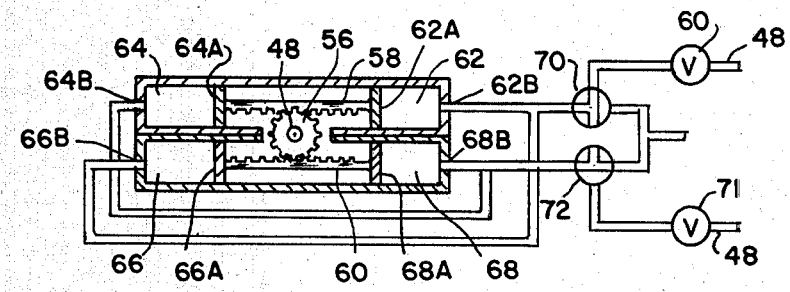
FIG. 6 is a partial cross-sectional view of a typical actuator means.

FIG. 6 is a partial cross-sectional view of a typical pneumatic actuator 36 showing the interconnection of the conduits 48 which control the rotational movement of the axel 44 thereby controlling the rotational movement of the arms 10 about their respective axis of rotation 14. Specifically, actuator 36 comprises a gear 56 locked to the axel 48 with the teeth of gear 56 engaging racks 58 and 60. The terminal ends of racks 58 and 60 are connected to pistons 62A, 64A, 66A, and 68A disposed in cylinders 62, 64, 66, and 68. Each of the cylinders 62, 64, 66 and 68 have a fluid input-output channel 62B, 64B, 66B, and 68B for enabling fluid communication with cylinders 62, 64, 66 and 68. When air pressure is applied into conduits 62B and 66B, piston 62A will move towards the left in FIG. 6 whereas piston 66A will move toward the right thereby causing counterclockwise rotation of gear 56. Conversely, when air pressure is applied to conduits 64B and 68B, piston 64A will move towards the right in FIG. 6 whereas, piston 68A will move toward the left thereby causing a clockwise rotation of gear 56. Valves 70 and 72 are provided to control the supply of air pressure to the conduits 62B, 64B, 66B, and 68B thereby controlling the direction and rate of rotation of gear 56. It should be understood that the conduits 48 may be connected to any suitable air pressure source, or alternatively, in the case of hydraulic actuators, the conduits 48 may be connected to any suitable hydraulic source. Regulator valves 69 and 71 are provided to create a uniform rate of rotation irrespective of gravitational or other forces acting on the arms. It should also be realized that the instant disclosure in FIG. 6 represents only a single particular actuator which may be incorporated into the instant invention. Many other hydraulic, mechanical, or electrical actuators may be incorporated to produce the same desired result.

Figure 7:
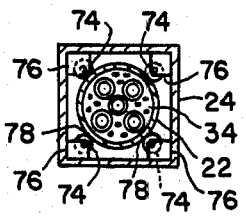
FIG. 7 is a cross-sectional view of FIG. 1 along lines 7—7 showing the drum disposed within the housing.

FIG. 7 illustrates the means for rotatably disposing the drum 22 within the housing 24. Specifically, a set of four bearing wheels 74 are journalled within the four corners of the forward and rearward ends of the housing 24 by means of brackets 76. The bearing wheels 74 mate with a raceway 78 disposed at the forward and rearward ends of the drum 22. Such mating retains the drum 22 within the housing 24 during rotation of the drum 22 thereby precluding longitudinal slippage of the drum 22 within the housing 24.

Means are provided to impart rotational movement to the drum 22 about the drum's axis of rotation 26. Such means comprises a motor 80 having an axel 82 extending parallel to the drum's axis of rotation 26. A first sprocket means 84 is connected to the axel 82 by means of a set screw 86 or the like. A second sprocket means 88 is then connected to the portion of the drum 22 which extends beyond the proximal end of the housing 22 by means of bolts 90 or the like. A continuous or endless chain 92 interconnects the first and second sprockets 84 and 88. As the motor 80 operates, the axel 82 thereof rotates which in turn rotates the drum 22 by means of the endless chain 92. In the preferred embodiment, motor 80 is operated by means of air pressure being supplied thereto by conduits 94 with valves 95A and 95B controlling the direction and rate of rotation. It is understood that the motor 80 may alternatively be any type of hydraulic or electromechanical motor which is able to operate in both a forward and a reverse mode. It is further understood that the endless chain 92 and the corresponding sprockets 84 and 88 may be replaced by V-belts, gears, or the like which would operate in substantially the same manner.

A brake assembly 96 is provided to brake the drum 22 and hold the drum 22 in a particular rotational position. The brake assembly 96 comprises a disc 98 which is connected to the axel 82 of the motor 80 by means of set screws, a keyway, or the like. A pair of brake calipers 102 is disposed about the disc 98 by means of a bracket 104 which is secured to the motor 80. Upon operation of the brake assembly 96 by means of control conduit 106 and valve 107 supplying air pressure thereto, the pair of brake calipers 102 compresses the disc 98 located therebetween to frictionally retard and eventually stop the movement of the drum 22. It should be noted that other brake assemblies could alternatively be used such as a drum brake assembly.

It should be noted that manual manipulation of the series of arms 16 is easily accomplished by controlling the operation of the actuators 36, motor 80, and brake assembly 96. In some applications, it may be desirable to automatically control the manipulation of the series of arms 16 to clean a particular work surface. In this case, a microcomputer 108 is provided which automatically controls the actuators 36, motor 80, and brake assembly 96. Specifically, microcomputer 108 comprises a microprocessor 110, random access memory (RAM) 112 and read only memory (ROM) 114, each of which is connected to the microcomputer bus 116 by means of address 118, data 120, and control 122 interconnections. A power supply 124 is also connected to the microcomputer bus 116 for powering the various components of the microcomputer 108. A terminal 126 such as a video terminal, line printer, keyboard, etc. is connected to an interface 128 which is in turn, connected to the microcomputer bus 116 by means of address 118, data 120, and control 122 interconnections. The terminal 126 provides a means in which the operator can communicate with the microcomputer 108.

A plurality of sensors are provided which sense the rotational position of the arms 10 about their respective axis of rotation 14 and the rotational position of the drum 22 within the housing 24. Specifically, the first sensor 130A senses the rotational position of the first arm 10 about the first axis of rotation 14. The second sensor 130B senses the rotational position of the second arm 10B about the second axis of rotation 14B. The third sensor 130C senses the rotational position of the third arm 10C about the third axis of rotation 14C. Finally, the fourth sensor 130D senses the rotational position of the drum 22 about the drum's axis of rotation 26. Each of the sensors are standard in the art and may comprise, for example, a potentiometer whose resistance changes proportionately as the core of the potentiometer is rotated. Such change in resistance is sensed by the microcomputer 108, thereby determining the rotational position of the arms 10 and the drum 22. Each of the sensors 130 are interfaced to the microcomputer 108 by means of an interface 132 which is connected to the microcomputer bus 116 by means of address 118, data 120, and control 122 interconnections.

Figure 8:
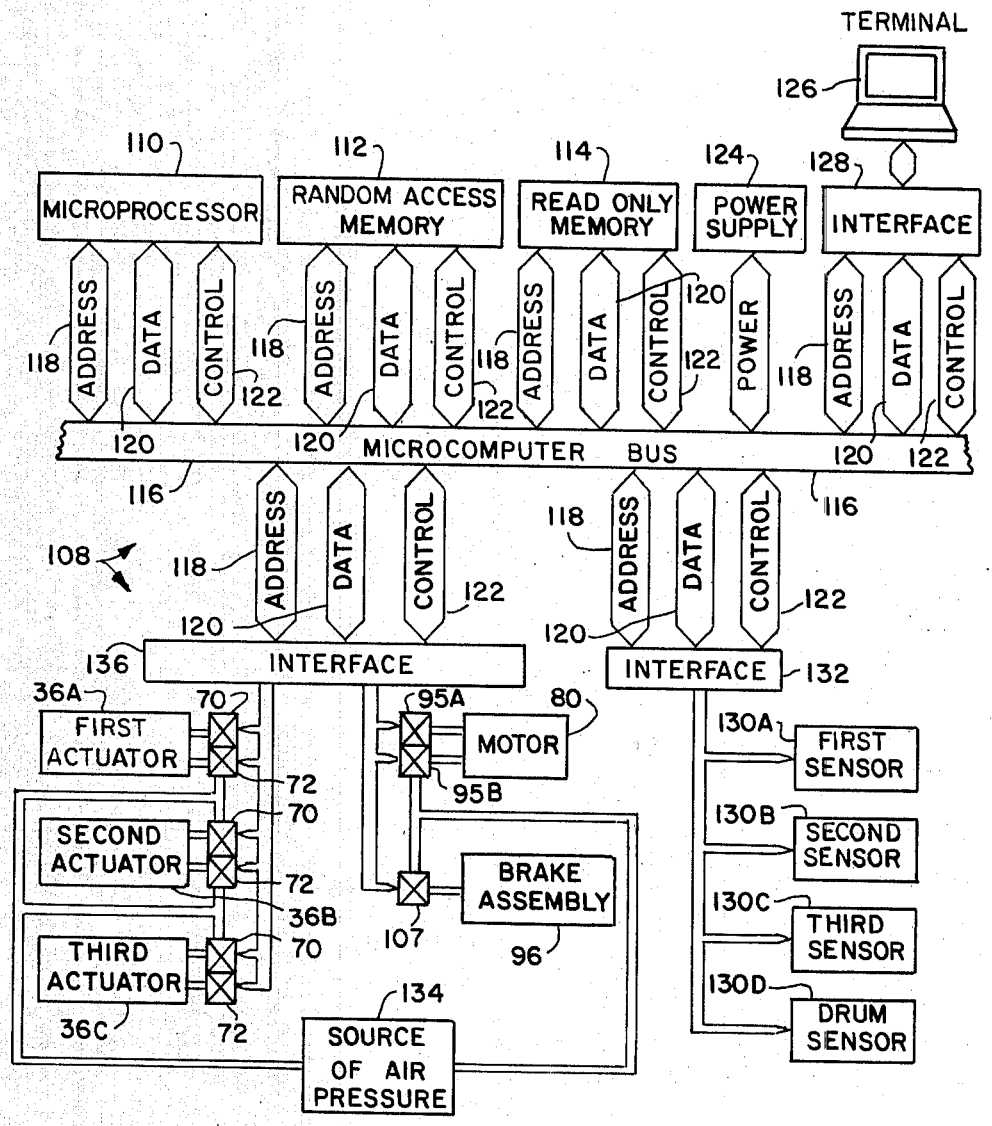
FIG. 8 is a block diagram of the microcomputer.

As noted earlier, the actuators 36 are controlled by the operation of valves 70 and 72 (see FIG. 6). As shown in FIG. 8, a source of air pressure 134 is connected to the valves 70 and 72 for powering the actuators 36. In a similar fashion, the pneumatic motor 80 is controlled by valves 95A and 95B which are connected to the source of air pressure 134. Finally, the operation of the brake assembly 96 is controlled by valve 107 which is connected to the source of air pressure 134. Each of the valves 70, 72, 95A, 95B and 107 are electromechanical valves such as solenoid operated valves which are connected to interface 136 which is in turn, connected to the microcomputer bus 116 by means of address 118, data 120, and control 122 interconnections.

It should be noted that the particular family or type of the various components of the microcomputer 108 are standard in the art, and therefore a detailed discussion of the operation thereof has been simplified in terms of the block diagram as shown in FIG. 8. Briefly, however, microprocessor 110 may comprise a four, eight, or sixteen bit microprocessor commonly found on today's market. RAM 112 stores the program which may be entered by terminal 126 thereby enabling the microcomputer 108 to operate in any desired manner. ROM 114 stores the permanent softwear of the microcomputer 108 such as the initialization programs and the standard programs which would be used most frequently. Each of the interfaces 128, 132, and 136 are also standard in the art and may comprise analog-to-digital converters or the like. The terminal 126 enables the user of the invention to select the particular program stored in ROM 114 which causes the microcomputer 108 to control actuators 36, motor 80 and brake assembly 96 in a manner enabling the nozzles 20 to sweep the work surface in a particular geometric pattern.

Figure 9:
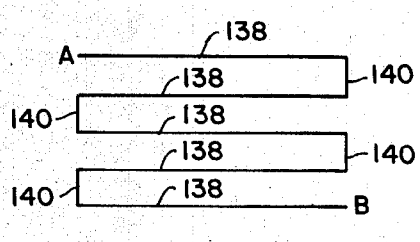
FIG. 9 is a planned view of a typical pattern which may be traced by the stream of abrasive and fluid emitted from the nozzles to clean the work surface.

FIG. 9 illustrates a specific geometric pattern in which the work surface may be cleaned through the manipulation of the arms 10. The softwear stored in the ROM 114 of the microcomputer 108 controls the operation of the actuators 36 to direct the stream of abrasive and fluid emitted from nozzles 20 to trace the particular geometric pattern. More specifically, starting at point A of the pattern, microcomputer 108 actuates actuator 36C thereby causing the first arm 10C to move from left to right to sweep the horizontal portion 138 of the pattern. The microcomputer 108 then actuates actuator 36A to downwardly sweep the vertical portion 140 of the pattern. The microcomputer 108 then actuates actuator 36C in a right to left direction to horizontally sweep the work surface along another horizontal portion 138 of the pattern. This procedure continues until the microcomputer 108 has controlled the operation of the actuators 36 to trace the entire pattern as shown in FIG. 9, ending at point B. It should be noted that the microcomputer 108 can be programmed to sweep various other geometric patterns other than the one shown in FIG. 9.

Figure 10:
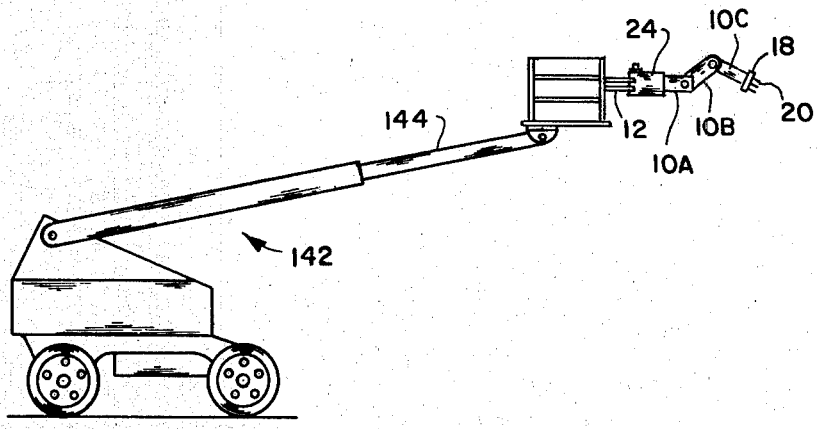
FIG. 10 is a plan view of the invention incorporated into a mobile chassis.

FIG. 10 is a side view of the subject invention incorporated into a mobile chassis 142. Specifically, the base 12 of the invention is bolted or welded to the distal end of a telescopic member 144 of the mobile chassis 142. The mobile chassis 142 enables the invention to be moved to a particular portion of the work surface whereby the invention may then be operated manually or by microcomputer 108 to clean such portion of the work surface. It should be noted that other mobile chassis such as the ones set forth in my prior patents may be utilized as a means to transport the subject invention to a particular area of the work surface.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been claimed:

1. An apparatus for spraying a work surface with material under pressure from a remote control surface with material under pressure from a remote control source of material and pressure, comprising in combination:

a base;

a first arm having a channel disposed therein along the length of said first arm;

a first means for rotatably mounting said first arm relative to said base enabling said first arm to rotate about a first axis of rotation;

a second arm having a channel disposed therein along the length of said second arm;

a second means for rotatably mounting said second arm relative to said first arm enabling said second arm to rotate about a second axis of rotation;

a third means for rotatably mounting said first arm relative to said base about a third axis of rotation;

said third axis of rotation being disposed substantially perpendicular to said first axis of rotation;

said third means for rotatably mounting said first arm including a housing;

said third means further including a drum rotatably mounted in said housing;

said third means further including means for connecting said housing to said base;

said third means further including means for imparting rotational movement to said drum; and means for connecting said first means to said drum.

2. The apparatus as set forth in claim 1, wherein said means for imparting rotational movement to said drum comprises in combination:

a motor having an axel extending therefrom;

a first sprocket gear mounted to said axel;

means for connecting said hydraulic motor to said housing;

a second sprocket gear connected to said drum;

a continouous chain means interconnecting said first and said second sprockets; and means for controlling the rotational movement of said motor.

3. The apparatus as set forth in claim 1, including means for braking the rotational movement of said drum.

4. The apparatus as set forth in claim 3, wherein said braking means, comprises in combination:

a disc concentrically connected to said axel of said hydraulic motor;

a caliper brake mechanism disposed about said disc; and means for controlling the actuation of said caliper brake mechanism.

5. The apparatus as set forth in claim 1, or 2 or 3 or 4, further comprising a first actuator means for rotating said first arm about said first axis of rotation;

a second actuator means for rotating said second arm about said second axis of rotation; and an actuator control means for independently controlling each said actuator means.

* * * * *